US010245495B2

(12) United States Patent
Dagn

(10) Patent No.: US 10,245,495 B2
(45) Date of Patent: Apr. 2, 2019

(54) TENNIS TRAINING DEVICE

(71) Applicant: Josef Dagn, Kössen (AT)

(72) Inventor: Josef Dagn, Kössen (AT)

( * ) Notice: Subject to any disclaimer, the term of this patent is extended or adjusted under 35 U.S.C. 154(b) by 0 days.

(21) Appl. No.: 15/786,525

(22) Filed: Oct. 17, 2017

(65) Prior Publication Data

US 2018/0104562 A1 Apr. 19, 2018

(30) Foreign Application Priority Data

Oct. 18, 2016 (DE) ..... 20 2016 105 816 U

(51) Int. Cl.

| | |
|---|---|
| ***A63B 69/38*** | (2006.01) |
| ***A63B 69/00*** | (2006.01) |
| ***A63B 43/00*** | (2006.01) |
| *A63B 21/008* | (2006.01) |
| *A63B 21/02* | (2006.01) |
| *A63B 71/00* | (2006.01) |
| *A63B 71/02* | (2006.01) |

(52) U.S. Cl.

CPC ..... *A63B 69/38* (2013.01); *A63B 43/002* (2013.01); *A63B 69/0091* (2013.01); *A63B 21/0087* (2013.01); *A63B 21/02* (2013.01); *A63B 43/008* (2013.01); *A63B 2071/0063* (2013.01); *A63B 2071/025* (2013.01); *A63B 2071/026* (2013.01); *A63B 2209/00* (2013.01); *A63B 2209/08* (2013.01); *A63B 2210/50* (2013.01); *A63B 2220/53* (2013.01); *A63B 2225/09* (2013.01); *A63B 2225/093* (2013.01)

(58) Field of Classification Search

CPC ... A63B 69/38; A63B 69/0091; A63B 43/008; A63B 71/023; A63B 2071/025; A63B 2071/026; A63B 2071/063; A63B 2071/0694; A63B 2209/00; A63B 2209/08; A63B 2220/53; A63B 2225/093; A63B 21/0087; A63B 21/02; A63B 43/002; A63B 2210/50

See application file for complete search history.

(56) References Cited

U.S. PATENT DOCUMENTS

| | | | | | |
|---|---|---|---|---|---|
| 2,578,313 | A | * | 12/1951 | Moseley | A63B 69/0091 473/426 |
| 2,713,487 | A | * | 7/1955 | Jaediker | A63B 69/0091 473/145 |
| 3,731,926 | A | * | 5/1973 | Vincent | A01K 15/025 273/142 R |
| 3,876,203 | A | * | 4/1975 | Gold | A63B 69/0075 473/417 |
| 3,924,853 | A | * | 12/1975 | Schleeger | A63B 69/0091 473/429 |
| 4,089,521 | A | * | 5/1978 | Berst | A63B 69/0091 473/429 |

(Continued)

FOREIGN PATENT DOCUMENTS

WO WO 2016/006767 A1 3/2014

*Primary Examiner* — Raleigh W Chiu
(74) *Attorney, Agent, or Firm* — Horst M. Kasper, Esq.

(57) ABSTRACT

A tennis training device is provided, comprising a support bar which is swivelable between a first and a second stop in its longitudinal direction, wherein at the free end of the support bar a ball is mounted by means of a connecting ember, which is releasably fixed by means of a fixing means. Furthermore, the invention relates to different embodiments of a training unit.

7 Claims, 5 Drawing Sheets

(56) References Cited

U.S. PATENT DOCUMENTS

Figure 4:
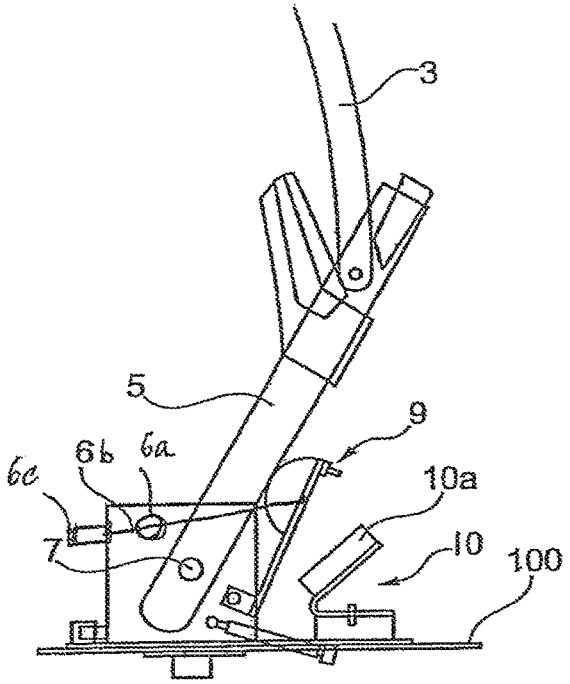

| | | | | | |
|---|---|---|---|---|---|
| 4,105,203 | A * | 8/1978 | Cho | A63B 69/0091 | 473/429 |
| 4,204,678 | A * | 5/1980 | Weis | A63B 69/0091 | 473/423 |
| 4,258,916 | A * | 3/1981 | Beam | A63B 69/0091 | 473/429 |
| 4,531,734 | A * | 7/1985 | Herrick | A63B 69/0091 | 473/429 |
| 4,679,790 | A * | 7/1987 | Ham | A63B 69/0091 | 473/429 |
| 4,989,867 | A * | 2/1991 | Herrick | A63B 69/0091 | 473/429 |
| 5,203,558 | A * | 4/1993 | An | A63B 69/0091 | 473/423 |
| 5,393,050 | A * | 2/1995 | Lloyd | A63B 69/0091 | 473/417 |
| 5,685,542 | A * | 11/1997 | Weis | A63B 69/0091 | 473/459 |
| 6,458,037 | B1 * | 10/2002 | Dixon, Jr. | A63B 69/0002 | 473/219 |
| 7,070,520 | B1 * | 7/2006 | An | A63B 69/0091 | 473/139 |
| 9,149,707 | B2 * | 10/2015 | Cochran | A63B 69/38 | |
| 2002/0111233 | A1 * | 8/2002 | Lloyd | A63B 69/0091 | 473/429 |
| 2006/0035729 | A1 * | 2/2006 | Wang | A63B 69/0002 | 473/417 |
| 2007/0054756 | A1 * | 3/2007 | Hanson | A63B 69/0091 | 473/451 |
| 2013/0196794 | A1 * | 8/2013 | Wheelbarger | A63B 69/20 | 473/422 |
| 2017/0203183 | A1 * | 7/2017 | Dagn | A63B 69/38 | |

* cited by examiner

TENNIS TRAINING DEVICE

The invention relates to a tennis training device anti especially to a holding device of a ball on a support bar.

WO 2016/008767 describes a tennis training device in which a ball is rotatably mounted at the free end of a section rod which is connected swivelably in the longitudinal direction to a support bar, which in turn is swivelably mounted at a base. Hereby, the section rod forms an elongation of the support bar.

The invention is based on the object of designing the mounting of the ball at a tennis training device such that different game situations can be trained better.

This is achieved according to the invention, in that the ball is mountable in an exchangeable manner and having different holding means at the tennis training device, so that different stroke techniques can be trained.

According to the invention, for a tennis training device in which a support bar supporting the ball is articulatedly mounted at a base and swivelable between a first and a second stop, at the free end of the support bar the ball is mounted at a connecting member which is releasably connectable to the end of the support bar by means of a fixing means.

In this way, according to playing technique, the ball can be exchanged at the support bar and, by means of different designs of the connecting member, is mounted at the support bar in suitable positions relative to the support bar.

Preferably an elastic extension is mounted at the ball, through which the ball is fixed movably in different directions at the connecting member, by means of which, during the stroke of a tennis racket against the ball, the ball can move in different directions.

Advantageously a preferably curved plate is mounted at the connecting member, at which plate the ball can be supported on a larger surface after the stroke by a tennis racket.

According to an advantageous embodiment, a tension element is mounted at the ball or at the radially protruding elastic extension, which tension element can be formed, for example, in the shape of a hook, which can be hooked onto the support bar in spaced openings. The tension element can be connected to the ball by a rubber band in order to keep the ball under tension in its initial position at the connecting member.

Hereby, the hook and the rubber band or the flexible extension extend through an opening in the curved plate which is provided for supporting the ball.

Preferably the connecting member is inserted into a hollow section rod which is connected to the support bar so that on the one hand, the exchanging is facilitated and on the other hand, a stable mounting of the ball is guaranteed by means of the connecting member.

According to an advantageous embodiment, the connecting member is fixable by means of screws to the hollow section rod, wherein the shaft of the screws engages a longitudinal slot of the section rod. In this way, the screws at the section rod can be fixedly clamped in a simple manner.

According to a further embodiment, the connecting member is formed twisted or wound in its longitudinal direction, so that when the ball is rotatably mounted, the rotational axis of the ball takes up an angle to the longitudinal direction of the support bar. In this way, special stroke techniques with a tennis racket can be practiced better.

Figure 1:
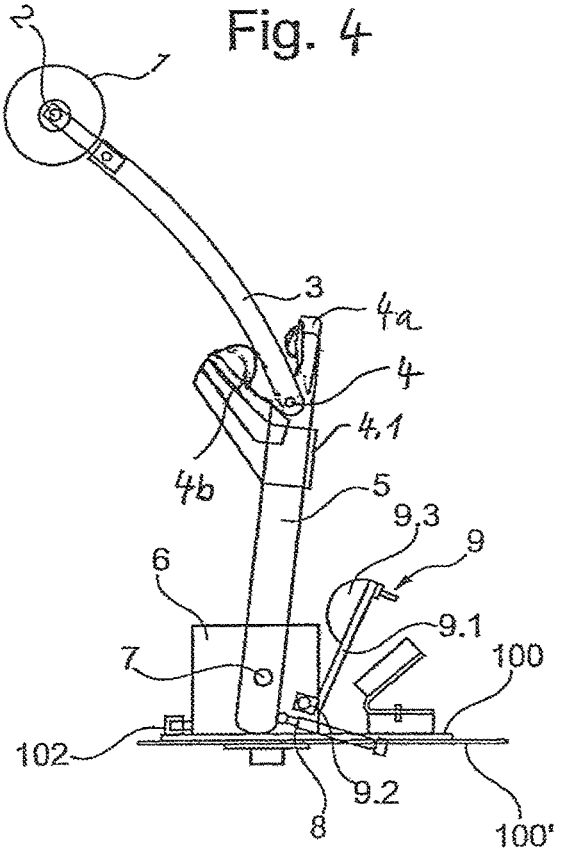
Figure 2:
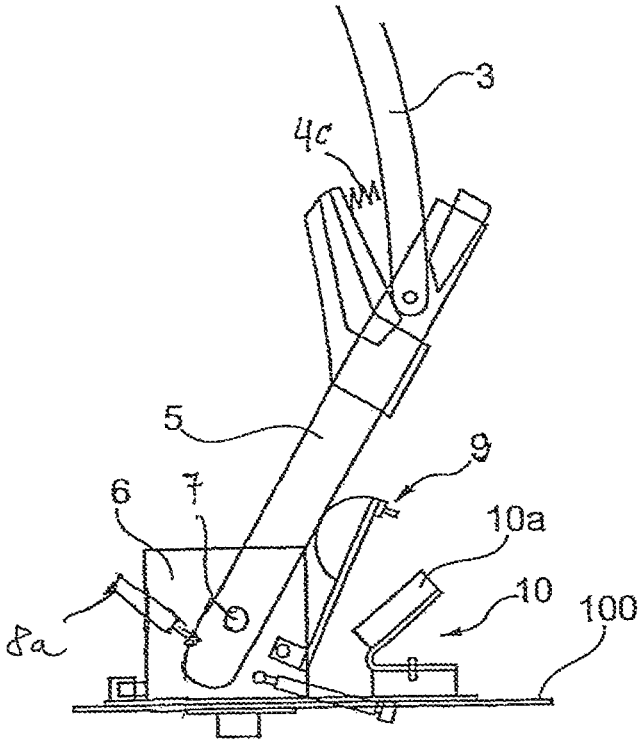
Figure 3:
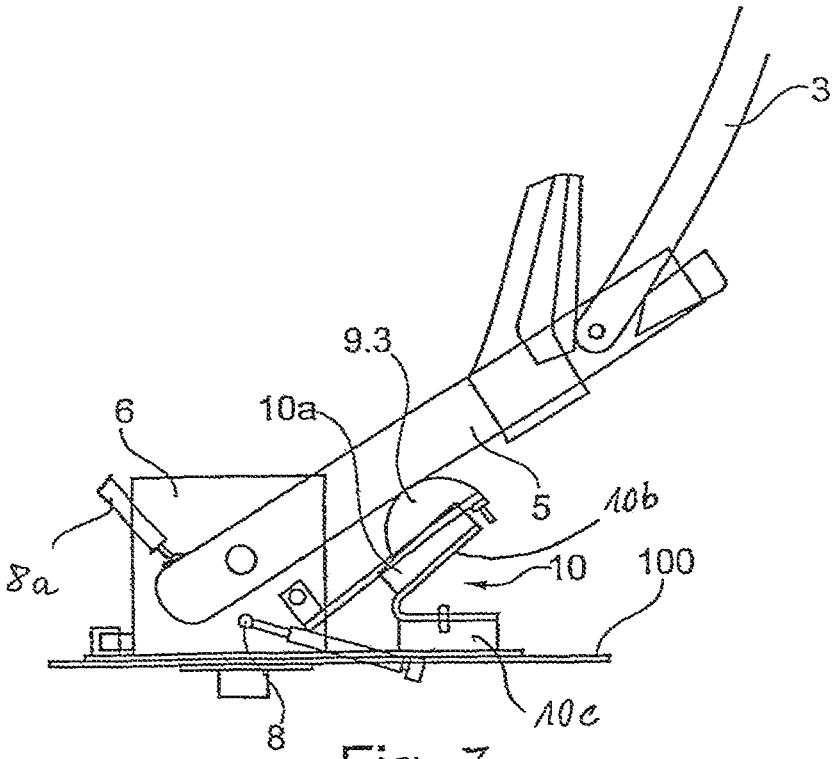
Figure 5:
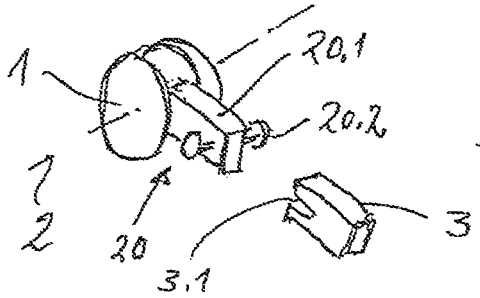
Figure 6:
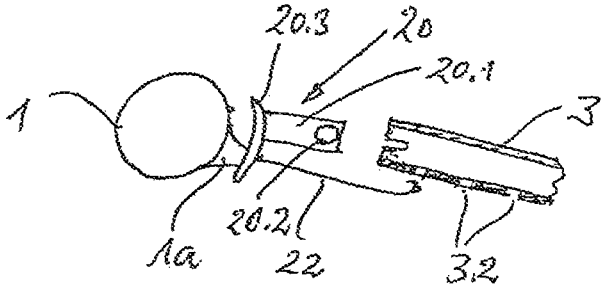
Figure 6A:
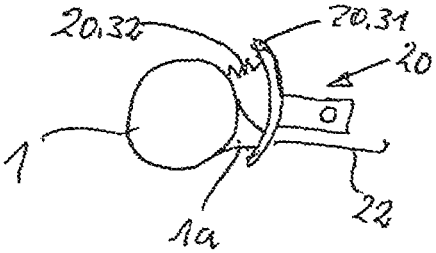
Figure 9:
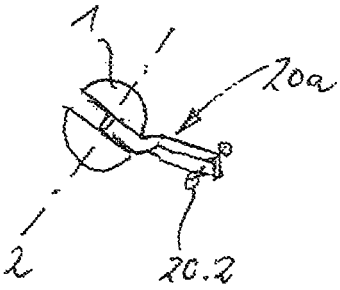
Figure 7:
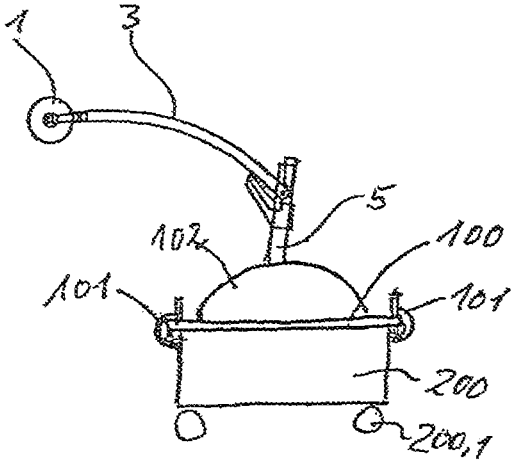
Figure 10:
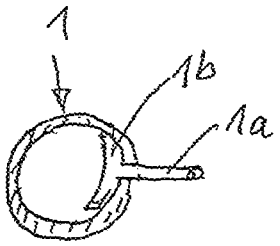
Figure 10A:
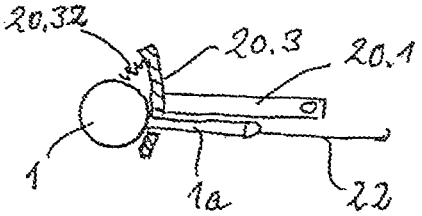
Figure 8:
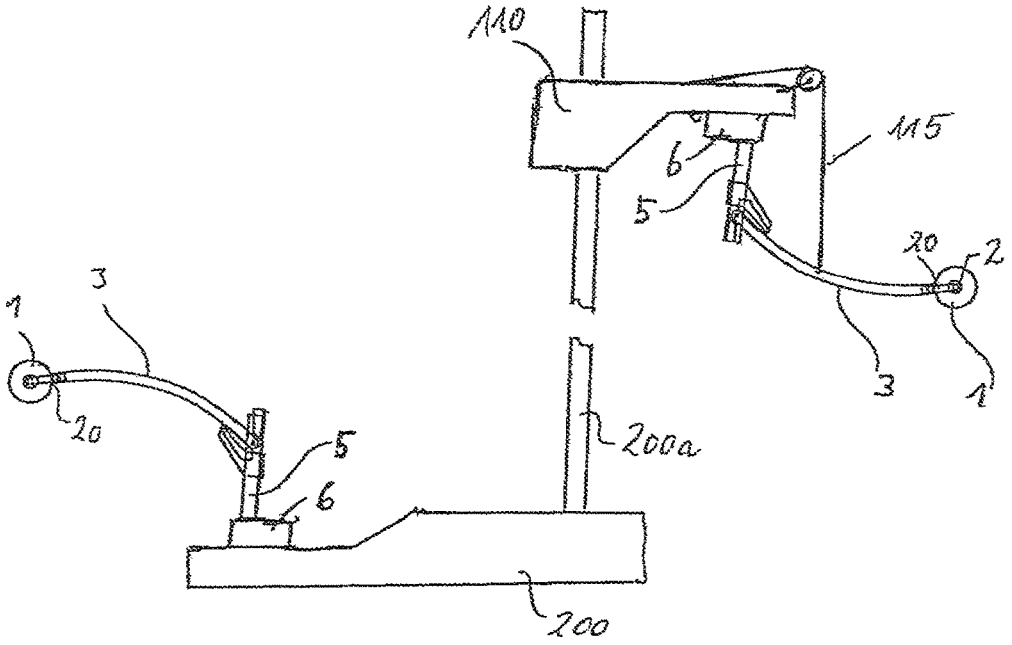

Exemplary embodiments of the invention are described in detail with reference to the drawing, in which FIG. 1 schematically shows an embodiment of a training device in a lateral view in the initial position without support of the second stop, FIG. 2 shows an intermediate position in the representation of FIG. 1 after carrying out a stroke, FIG. 3 shows the end position after carrying out a stroke in the representation of FIGS. 1 and 2, FIG. 4 shows a modified construction, FIG. 5 shows a perspective view of an exchangeable holding device of the ball at the section rod, FIG. 6 shows a lateral view of a further embodiment of the holding device of the ball at a connecting member, FIG. 6*a* shows a modified construction of the embodiment according to FIG. 6, FIG. 7 schematically shows the mounting of the training device at a chassis, FIG. 8 schematically shows a lateral view of a combined training device having two identical training units, FIGS. 9+9*a* show a view of a holding device of the ball having a twisted or wound connecting member for a training device for training slice serves and kick serves, also called topspin, FIG. 10 shows a cross-section through a ball having an elastic extension, and FIG. 10*a* shows a side view of a ball mounting device.

FIG. 1 shows an embodiment of a tennis training device in a lateral view, wherein a ball 1 is rotatably supported at 2, preferably by a ball bearing at the end of a section rod 3, for example an aluminum rectangular tube curved contrary to the direction of stroke, having a rotational axis perpendicular to the plane of the drawing. The section rod 3 is rigid and in practice it is formed longer than shown. Its opposite end is swivelably supported, preferably by means of ball bearings, at 4 at the upper end portion of a support bar 5 which is short in relation to the section rod.

The curve of the section rod 3 protruding from the support bar 5 is designed such that for example when carrying out a slice stroke, after hitting the ball the racket can freely follow through and is not hindered by the swiveled section rod (FIGS. 2 and 3).

The swivelable mounting support 4 of the section rod 3 can be formed at a sleeve 4.1, which is displaceable along the support bar 5, wherein the sleeve 4.1 is fixedly connected with the support bar 5. In this way, the section rod 3 forms an extension of the support bar 5.

Stops are provided in the area of the place of articulation 4 of the section rod 3 at the support bar 5, and between these stops the section rod 3 is swivelable relative to the support bar 5, wherein the stops are advantageously provided with an elastomeric coating and with a damping pad.

FIG. 1 shows an upper damper 4*a* having an elastomeric pad which is fixedly connected with the support bar 5. Further, a lower damper 4*b* is fixedly connected with the support bar 5, and the section rod 3 abuts at this lower damper in the resting position represented in FIG. 1.

Also, a spring action can be provided, which counteracts a swiveling movement of the section rod 3 out of the position of FIG. 1 into the position of FIG. 3 and which displaces the section rod 3 out of the swivel position in FIG. 3 back into the initial position of FIG. 1.

In particular, a leaf spring can also be provided at the mounting support 4, which acts on the swivel movement of the section rod 3 to guarantee an elastic striking action of the racket on the ball 1.

FIGS. 1 to 3 show the basic structure of the articulation of the support bar 5 at a base plate 100.

The support bar 5 is swivelably supported at 7 at the lower end in or at a bearing block 6. The bearing block 6 can consist of two metal plates having an L-shaped cross-section, wherein the shorter legs of the metal plates are fixed at the base plate 100. The swivel movement of the support bar 5 in the direction of stroke is limited by a first stop 8. In the initial position of FIG. 1, the support bar 5 abuts with its lower end at the first stop 8, which is formed as a gas pressure spring in the embodiment of FIGS. 1 to 3.

Instead of a gas pressure spring 8, another stop can also be provided, preferably having a damping effect, as represented in the further embodiments which are described in the following.

In FIG. 2, after a stroke on the ball with the tennis racket, the support bar 5 strikes a second stop 9 when carrying out its swiveling movement in clockwise direction around the articulation point 7. In this embodiment, stop 9 is swivelably supported at the bearing block 6 at 9.2. The second stop 9 is formed by a strut 9.1 having an elastomeric pad 9.3 at the free end thereof, which the support bar 5 strikes when carrying out its swiveling movement. In FIGS. 1 to 3, the second stop 9 is supported in an elastically resilient way in the direction of stroke to the right, for example by an elastic pad which, in this embodiment, is mounted at a bracket **10*b* which is fixedly connected with the base plate 100 and can be elastically supported at 10*c* on the base plate 100**.

Preferably, the second stop 9 is supported in an elastically resilient way by means of a construction represented in FIG. 4, in which a preferably rotatable pin **6*a* having a transverse bore is mounted at the bearing block 6 on both sides. A rope 6*b* is guided through the transverse bore and fixed at one end to the support bar 9.1 of the stop 9, and on the other side of the pin 6*a* this rope supports a buffer 6*c* at the end in a freely moveable manner. During the swiveling movement of the second stop 9, the buffer 6*c* comes to abut at the pin 6*a* and damps the swiveling movement of the second stop 9**.

After the support bar 5 has come to abut at the second stop 9 in the position in FIG. 3, the elastic support of the second stop 9 comes into effect during the follow-through swiveling movement of the support bar 5 in clockwise direction.

In the end position of FIG. 3, the support bar 5 is damped in two ways, first, by the damper pad 9.3 and the resilient support by means of the buffer **6*c*, and second, by means of the damping pad 10*a*, which forms a third stop 10**.

The buffers **6*c* are designed in relation to the pins 6*a* such that they preferably come into effect approximately at the same time with the striking of the holding plate 9.1 on the damping pad 10*a***.

Preferably, the effect of the buffers **6*c* and the length of the ropes 6*b*** is adjustable.

Also, springs can be provided at the rope of the buffers **6*c*** for further damping.

The free oscillation of the ball 1 out of the initial position in FIG. 1 until striking the support bar 5 at the second stop 9 in FIG. 2 forms a kind of idling range, because the stroke on the ball 1 substantially only has to overcome the ball's own weight. In practice, the section rod 3 protrudes relatively steeply from the support bar 5, so the weight of the section rod does not increase the resistance during the striking of the racket on the ball. Thus this idling range until striking the second stop 9 favors a slight resistance at the ball 1 when the racket strikes.

In FIG. 3, the device moves itself, or is supported to move out, of the end position by means of a tension spring, back into the initial position of FIG. 1. As soon as the support bar 5 is in a position corresponding to FIG. 2, in which the damping stop 9 is no longer swiveled further in anti-clockwise direction, the weight of the section rod 3 protruding from the support bar 5 and of the ball 1 acts on the support bar 5 such that it moves further back in anti-clockwise direction into the initial position of FIG. 1, wherein the lower end of the support bar 5 comes to abut at the preferably damped stop 8 and is decelerated.

In this embodiment the gas pressure damper 8 serves to make sure that the return of the ball 1 takes place at an even speed and the ball 1 returns smoothly into the initial position of FIG. 1. However, the stop 8 can also be formed in another manner, for example by a rubber buffer.

To decelerate the support bar 5 when carrying out a forceful stroke, additionally a damper 88 is provided, which in FIG. 2 abuts at the support bar 5 and decelerates it when swiveling in the direction of stroke, after the ball has already moved away from the racket.

Like all the other dampers and springs, this damper can also be adjustable with regard to damping effect.

FIG. 5 shows a perspective view of a holding device of the ball 1 in the form of a connecting member 20, which is exchangeably mounted at the end of the section rod 3, so that different types of balls can be fixed at the section rod 3 or a worn-out ball can be exchanged. For a rotatable ball 1 supported at a rotational axis 2, the connecting member 20 substantially has a rectangular piece 20.1, which is inserted into the rectangular hollow profile of the section rod 3. At the connecting member 20.1 fixed at the bearing of the ball, winged screws or knurled screws 20.2 are mounted on both sides, whose shafts engage guide grooves 3.1 at the end of the section rod 3.

FIG. 6 shows another embodiment of a holding device of the ball. An extension **1*a* of elastic material, such as rubber, is adhered or vulcanized onto the ball 1 and protrudes radially from the ball and is provided at the end with a hook member 22, which can be hung in openings 3.2 provided spaced apart at the end of the section rod, to keep abutting of the ball under tension at the connecting member 20. Advantageously, a plate 20.3 is provided at the connecting member, on which plate the ball 1 is supported during a stroke. This plate can be curved in a concave manner on the side facing the ball 1**.

While for the embodiment according to FIG. 5 preferably a less hard ball is used corresponding to a usual tennis ball having a relatively thin rubber layer, in the embodiment of FIG. 6 a ball having a thicker rubber layer of approximately 6 mm is used, as is also used for ball-throwing machines. This ball is harder and suitable for very forceful strokes.

FIG. 6 shows a modified embodiment, in which an extension 20.31, curved in the circumferential direction of the ball, of the supporting plate 20.3 is mounted at the connecting member 20, and additionally supports the ball in the case of forceful strokes. Hereby, a pressure spring 20.32 can be provided between ball and extension 20.31, in order to support the ball resiliently against the extension of the plate 20.3 of the connecting member 20.

The advantage of mounting the ball according to FIGS. 6 and **6*a* lies in that the ball can move laterally due to the elastic extension 1*a*. This mounting of the ball according to FIGS. 6 and 6*a* is suitable above all for professional players who carry out forceful strokes, like in a tournament, while the rotatable support according to FIG. 5** is very suitable for perfecting a stroke during training.

In the case of the mounting of the ball according to FIGS. 6 and **6*a*, an impact sensor can be provided between ball 1 and plate 20.3 of the connecting member 20**.

FIG. 7 schematically shows a training unit provided with a covering hood 102 corresponding to FIG. 1, at the base plate 100 of which, for example quick-release fasteners or tension clamps 101 are mounted, by means of which the training unit can be fixed at a stable chassis 200. In FIG. 7, a movable chassis is indicated, which can be embodied relatively heavy, wherein the rollers 200.1 are provided with a blocking means so that a stable base for the training unit is obtained.

FIG. 8 schematically shows a combined training device in which a rod 200*a* is fixed on the right side of a stable chassis 200, on which rod in a height-displaceable manner a socket 110 is mounted with the training unit overhead, for practicing serve strokes. On the other side of the chassis 200, an identical training unit, for example, corresponding to FIG. 1, is mounted preferably detachably corresponding to FIG. 7, for practicing forehand and backhand strokes.

In contrast to the training unit on the left side in FIG. 8, in which the section rod 3 substantially swivels back by its own weight into the initial position, in the case of the overhead arrangement a return spring 115 is provided on the right side, which, after a serve stroke is carried out, returns the section rod 3 back into the raised initial position of FIG. 8.

For training serve strokes, in FIG. 8 a ball 1 having a rotational axis 2 perpendicular to the plane of the drawing is mounted at the connecting member 20, so that preferably cannonball serves can be practiced. In order that kick and slice serves can also be practiced, the connecting member 20 is twisted in different directions, as FIG. 9 shows, so the axis 2 of the rotatable support of the ball no longer lies vertically to the plane of the drawing as in FIG. 8, but inclined thereto, when a connecting member 20*a*, represented in FIG. 9, which is twisted and has an approximately rectangular cross-section, is mounted at the section rod 3.

Figure 9A:
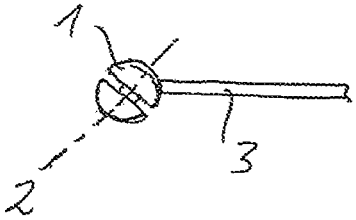

FIG. 9*a* schematically shows an inclined position of the rotational axis 2 to the longitudinal direction of the section rod 3 when using a twisted connecting member 20*a* in FIG. 9. In the case of a kick serve, the rotational axis 2 of the ball 1 is approximately 5 to 1° steeper in relation to the longitudinal axis of the section rod 3.

Different embodiments of the described constructions are possible. For example, in FIG. 8, the training unit mounted upright can be mounted on the left side, also in a height-displaceable manner, at the chassis 200.

The holding devices of the ball described by means of FIGS. 5, 6 and 9 can also be mounted at a different construction of a tennis training device than the one described.

For the design of the damper 10*a* at the second stop 9, a spring surrounded by an elastomeric material can also be used.

FIG. 2 shows a spring 4*c* between section rod 3 and left support, so that the section rod is resiliently supported when swiveling back.

FIG. 10 shows a cross-section through a ball having a radially protruding, elastic extension 1*a*. A mushroom-shaped part 1*a*, 1*b* made of rubber material is inserted into a ball divided, for example, into two halves, wherein the extension 1*a* extends through a bore in the circumferential surface of the ball. The plate-shaped part 1*b* of the mushroom-shaped insert is adhered on the inside of the ball or joined to the rubber material of the ball by vulcanizing. Preferably, a loop or a hook member is mounted at the end of the elastic extension 1*a*, at which loop or hook member a tensioning member can engage and can be hooked on for placing the ball under tension at the support bar 5 or at the section rod 3 as shown in FIG. 6.

A bore or a slot can be provided at the plate 20.3 of the connecting member 20, through which bore or slot the extension 1*a* or the tensioning member fixed at the extension 1*a* extends.

FIG. 10*a* shows a preferable embodiment of the mounting of a ball on a connecting member 20, wherein the ball 1 abuts on the plate 20.3 and the extension 1*a* extends through a bore in the plate 20.3.

The invention claimed is:

1. Tennis training device, comprising a support bar (5) supporting a ball (1) and swivelable between a first stop (8) and a second stop (9) at a base, wherein the ball (1) is mounted at the free end of the support bar, characterised in that the ball (1) is mounted at a connecting member (20) which is releasably fixed at the free end of the support bar by a fix ng cans (20.2), wherein the ball (1) is mounted at the connecting member (20) in such a way as to be movable in different directions by means of an elastic extension (1*a*) which protrudes in radial direction from the ball, and wherein a plate (20.3) is mounted at the connecting member (20) for supporting the ball (1).

2. Tennis training device, comprising a support bar (5) supporting a ball (1) and swivelable between a first stop (8) and a second stop (9) at a base, wherein the ball (1) is mounted at the free end of the support bar, characterised in that the ball (1) is mounted at a connecting member (20) which is releasably fixed at the free end of the support bar by a fixing means (20.2), wherein the ball (1) is mounted at the connecting member (20) in such a way as to be movable in different directions by means of an elastic extension (1*a*) which protrudes in radial direction from the ball, wherein a plate (20.3) is mounted at the connecting member (20) for supporting the ball (1) and wherein the plate (20.3) is curved concave on the side of the ball.

3. Tennis training device comprising a support bar (5) supporting a ball (1) and swivelable between a first stop (8) and a second stop (9) at a base, wherein the ball (1) is mounted at the free end of the support bar, characterised in that the ball (1) is mounted at a connecting member (20) which is releasably fixed at the free end of the support bar by a fixing means (20.2), wherein the ball (1) is mounted at the connecting member (20) in such a way as to be movable in different directions by means of an elastic extension (1*a*) which protrudes in radial direction from the ball, and wherein a hook member or tensioning member (22) is mounted at the extension (1*a*) of the ball (1) and is hookable in openings (3.2) at the end of the support bar in order to keep the ball (1) under tension in relation to the connecting member (20).

4. Tennis training device comprising support bar (5) supporting a ball (1) and swivelable between a first stop (8) and a second stop (9) at a base, wherein the ball (1) is mounted at the free end of the support bar, characterised in that the ball (1) is mounted at a connecting member (20) which is releasably fixed at the free end of the support bar by a fixing means (20.2), wherein the ball is supported rotatable at the connecting member (20), wherein the connecting member (20) has a cross-sectional profile which corresponds to that of the hollow cross-section of the end of the support bar, so the connecting member is insertable in the support bar, and wherein the connecting member (20) is fixable by means of screws (20.2) to the support bar and the shaft of the screw engages in a longitudinal slot (3.1) of the support bar.

5. Tennis training device according to claim 4, wherein the connecting member (20) is formed such that the rotational axis (2) of the ball (1) takes up an angle to the longitudinal direction of the support bar.

6. Tennis training device comprising a support bar (5) supporting a ball (1) and swivelable between a first stop (8) and a second stop (9) at a base, wherein the ball (1) is mounted at the free end of the support bar, characterised in that the ball (1) is mounted at a connecting member (20) which is releasably fixed at the free end of the support bar by a fixing means (20.2), wherein the ball (1) is mounted at the connecting member (20) in such a way as to be movable in different directions by means of an elastic extension (1*a*) which protrudes in radial direction from the ball, wherein a plate (20.3) is mounted at the connecting member (20) for supporting the ball (1), and wherein a training unit is mounted at a chassis (200) overhead on a rod (200*a*) in a height-displaceable manner and an identical training device is mounted at the opposite side of the chassis (200) in an upright position.

7. Tennis training device according to any one of claims 1, 4 and 6, wherein the support bar (5) is elongated by means of a section rod (3), at the free end of which the connecting member (20) is exchangeably fixed and the section rod (3) is swivelably connected to the support bar in the direction of stroke and in the longitudinal direction of the support bar (5).

* * * * *